US006000952A

United States Patent [19]

Gladd et al.

[11] Patent Number: 6,000,952

[45] Date of Patent: Dec. 14, 1999

[54] INTERCONNECT SYSTEM FOR INTERGRATING A BUSSED ELECTRICAL DISTRIBUTION CENTER WITH A PRINTED CIRCUIT BOARD

[75] Inventors: Joseph Howard Gladd, Cortland; Jeffrey Michael Hickox, Middlefield, both of Ohio; Andrew Frank Rodondi, Sharpsville, Pa.; Sean Michael Kelly, Williamsville, N.Y.; William Shane Murphy, Chanhassen, Minn.

[73] Assignees: Delco Electronics Corporation, Kokomo, Ind.; General Motors Corporation, Detroit, Mich.

[21] Appl. No.: 09/163,138

[22] Filed: Sep. 29, 1998

[51] Int. Cl.[6] ..... H01R 9/09

[52] U.S. Cl. ..... 439/76.2; 439/76.2; 439/74; 439/75; 439/62; 439/949; 361/736; 361/752; 361/775

[58] Field of Search ..... 439/76.2, 949, 439/74, 75, 62, 44, 45; 361/775, 736, 752

[56] References Cited

U.S. PATENT DOCUMENTS

| | | | |
|---|---|---|---|
| 3,701,964 | 10/1972 | Cronin | 339/17 |
| 3,897,126 | 7/1975 | Frances et al. | 339/17 |
| 4,689,718 | 8/1987 | Maue et al. | 361/360 |
| 5,653,607 | 8/1997 | Saka et al. | 439/402 |
| 5,788,529 | 8/1998 | Borzi et al. | 439/364 |
| 5,831,814 | 11/1998 | Hamill | 361/627 |

*Primary Examiner*—Paula Bradley
*Assistant Examiner*—Truc Nguyen
*Attorney, Agent, or Firm*—Patrick M. Griffin

[57] ABSTRACT

An integrated BEDC and PCB provided through a low cost, highly reliable interconnect system. The upper and/or lower half of the main insulation assembly of a BEDC is provided with a recess for accommodating at least an edge portion of the substrate of a PCB. The PCB is provided with apertures such as holes for receiving therethrough a buss wire and/or terminal slots through which terminals having wire slots are fixedly staked. The apertures on the PCB are arranged in a predetermined pattern so as to align with corresponding respective apertures in the form of corresponding holes and/or terminal slots on the BEDC at the recess thereof. Accordingly, with the PCB seated in the recess, as the buss wires are laid, they will pass through the holes in the PCB and/or pass through the wire slot of the terminals and thereby provide interconnection therebetween when the two halves of the main insulation assembly are united and the PCB is sandwiched therebetween.

10 Claims, 5 Drawing Sheets

INTERCONNECT SYSTEM FOR INTERGRATING A BUSSED ELECTRICAL DISTRIBUTION CENTER WITH A PRINTED CIRCUIT BOARD

TECHNICAL FIELD

The present invention relates to bussed electrical distribution centers having bussed circuits and/or various electronic components and to printed circuit boards composed of a dielectric substrate having various side-mounted and stick-leaded electronic components, and more particularly to an interconnect system for providing a direct connection therebetween.

BACKGROUND OF THE INVENTION

A bussed electrical distribution center (hereinafter referred to simply as a "BEDC") is a stand-alone central junction block assembly which has gained increasing applications in the automotive arts as motor vehicles become ever more electronically sophisticated. BEDC's package, for example, various fuses, relays and electronic devices in a single central location. BEDC's not only save cost by consolidating electrical interconnections, advantageously the number of cut and spliced leads is reduced, thereby increasing reliability.

A BEDC construction which is considered state of the art is described in U.S. Pat. No. 5,715,135, to Brussalis et al, dated Feb. 3, 1998, which is assigned to the assignee of the present invention, the disclosure of which is hereby incorporated by reference herein.

In the BEDC described in U.S. Pat. No. 5,715,135, a two-piece main insulation assembly is provided. Stamped male blade or tuning fork terminals are press-fit between the main insulation assembly, wherein the terminals are provided with a wire slot. The upper half of the main insulation assembly has a top surface provided with a plurality of terminal stations and guide stations that are raised and separated from each other so as to provide a network of channels that provide wire passages. The terminal stations have IDC (insulation displacement) type terminal slots that extend through the upper half of the main insulation assembly and allow a press-fit affixment of the terminals, wherein the wiring slots thereof intersect the wiring passages. The lower half of the main insulation assembly is configured similarly. When a segment of buss wire (preferably solid copper) is routed selectively along the wiring channels, the buss wire segment is pressed through the wire slot of a selected number of the terminals to thereby electrically connect those terminals therewith.

A printed circuit board (hereinafter simply referred to as a "PCB"), is a board-like, electrically interfaced package of electronic components which has become ubiquitous in the electrical arts. PCB's typically are in the form of a dielectric substrate (such as for example an organic resin reinforced by fibers) and a predetermined pattern of perforations for making connections with wiring and electrical devices, wherein a conductive path, usually cladded copper, is patterned so as to provide a predetermined electrical routing between the perforations so that the wiring and electrical devices are functionally interconnected.

Referring now to FIG. 1, a prior art interconnection system for electrically interfacing a BEDC with a PCB is depicted for an automotive environment of operation. In this automotive environment, a BEDC 10 is connected by a wiring harness 12 to a PCB 14. At each connection of the wiring harness 14, a connector 16, 18 is required. Further, the connectors 16, 18 must be enlarged, or additional connectors must be provided, in order to interface with separate wiring 20, 22 that must communicate with various electrical components of the motor vehicle.

The prior art interconnection system of FIG. 1 has several disadvantages, among these are: high cost of interface via a wiring harness; lower reliability due to use of numerous connectors; large volume of space allocated for the separate BEDC and PCB; and intensive assembly labor. Accordingly, what remains needed in the art is a connection system of providing an integrated BEDC and PCB.

SUMMARY OF THE INVENTION

The present invention is an integrated BEDC and PCB provided through a low cost, highly reliable interconnect system.

The upper and/or lower half of the main insulation assembly of a BEDC is provided with a recess for accommodating at least an edge portion of the substrate of a PCB. The PCB is provided with apertures in the form of holes for receiving therethrough a buss wire and/or terminal holes/slots through which terminal pins and/or terminals optionally having wire slots are fixedly staked. The apertures on the PCB are arranged in a predetermined pattern so as to align with corresponding respective apertures in the form of holes and/or terminal slots on the BEDC at the recess thereof. Accordingly, with the PCB seated in the recess, as the buss wires are laid, they will plant into the holes in the PCB and/or pass through the wire slot of the terminals. The planted buss wires and inserted terminal pins and/or terminals are selectively soldered to the cladding of the PCB, and any remaining terminals are then inserted.

Now, when the two halves of the main insulation assembly are united, they sandwich the PCB therebetween into an integrated module that handles, for example, all circuit bussing, relay, fuse and computer functions, wherein motor vehicle connections interface through the BEDC.

Accordingly, it is an object of the present invention to provide an integrated BEDC and PCB.

It is an additional object of the present invention to provide an interconnect system for connecting a PCB to a BEDC, wherein connectors and wiring harnesses are obviated.

It is a further object of the present invention to provide an interconnect system for directly connecting a PCB to a BEDC, wherein assembly labor is minimized.

It is yet another object of the present invention to provide an interconnect system for directly connecting a PCB to a BEDC, wherein reliability is enhanced.

It is still a further object of the present invention to provide an interconnect system for directly connecting a PCB to a BEDC, wherein component volume allocated therefor is minimized.

These, and additional objects, advantages, features and benefits of the present invention will become apparent from the following specification.

DESCRIPTION OF THE PREFERRED EMBODIMENT

Figure 1:
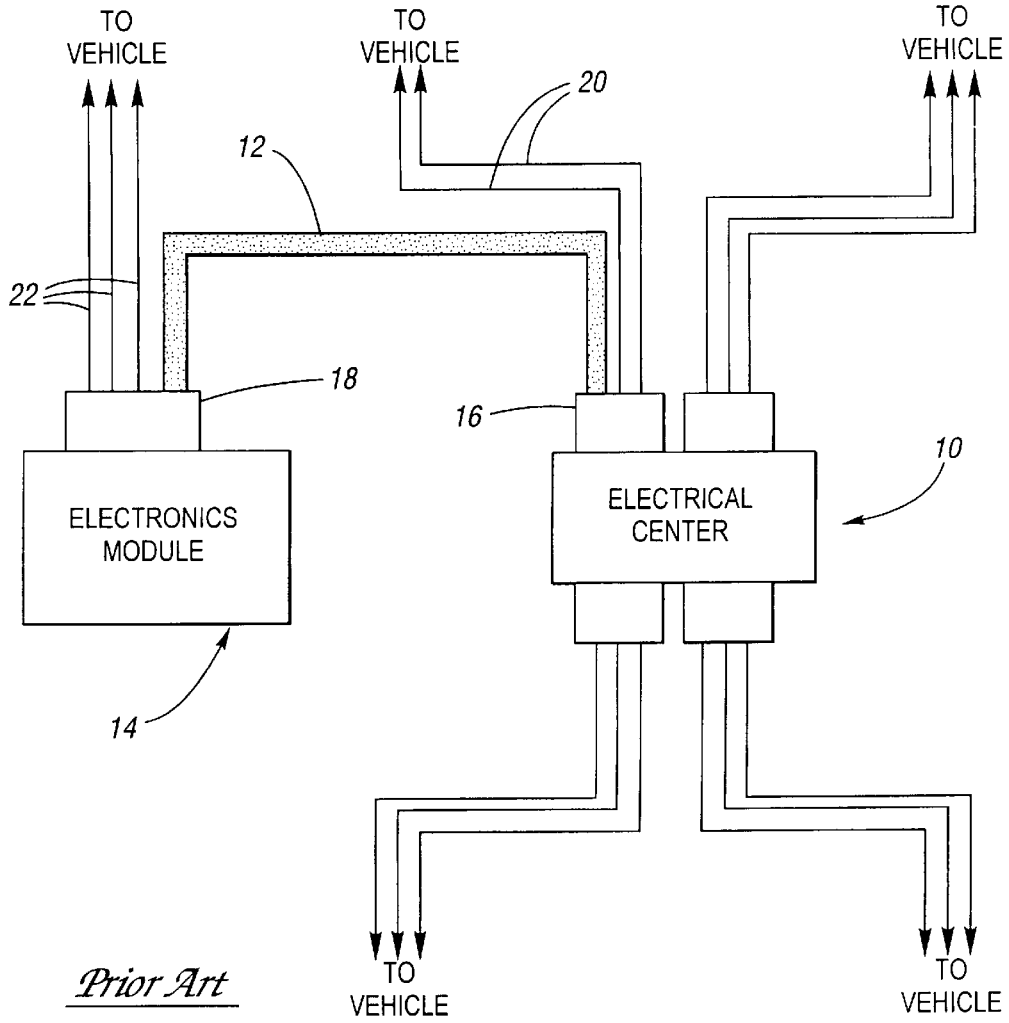
Prior Art Fig. 1
FIG. 1 is a schematic view of a prior art connection system for connecting a PCB to a BEDC.

Referring now to the Drawings, FIGS. 2*a* through 2*e* depict a series of steps according to the interconnect system 100 of the present invention. In this regard, a bussed electrical distribution center (BEDC) described in U.S. Pat. No. 5,715,135 is utilized herein by way of example.

Figure 2A:
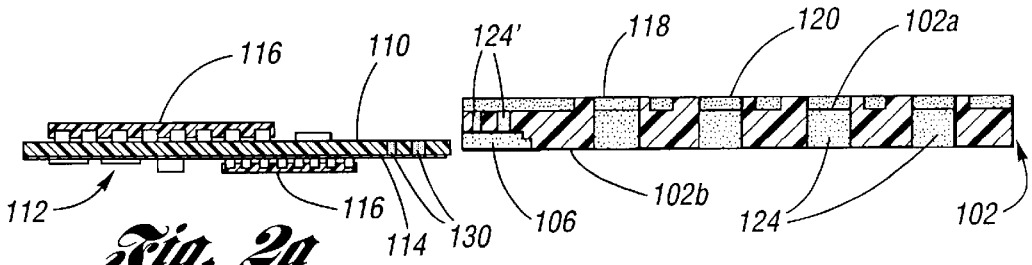
FIGS. 2*a* through 2*e* are partly sectional side views of steps for interconnecting a PCB with a BEDC according to the present invention.
Figure 2B:
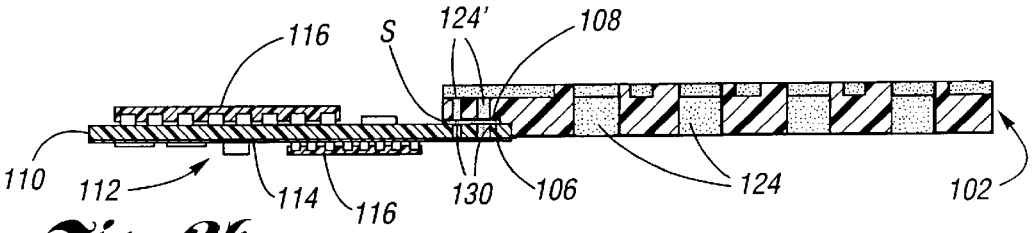

As indicated at FIG. 2*a*, an upper half member 102 of a two piece main insulation assembly 104 (see FIG. 2*e*) is provided with a recess 106 at the inner face 102*b* thereof, wherein the inner face is preferably characterized by side rails and grooved beams in the manner described in U.S. Pat. No. 5,715,135. The recess 106 is located at an end portion of the upper half member 102 and provides seating of an end portion 108 of a substrate 110 of a populated printed circuit board (PCB) 112, wherein the seating preferably is abutting at the edge of the PCB and is separated by a spacing S adjacent the edge, as shown at FIG. 2B. The PCB 112 includes a conductive path 114 cladded to the substrate 110 and various electronic components 116 connected with the conductive path. Apertures 130 in the form of holes and/or slots are provided in the PCB 112 at the end portion 108.

As recounted in U.S. Pat. No. 5,715,135, the outer face 102*a* of the upper half member 102 is provided with various raised guides 118 for providing wiring channels 120 for buss wires 122 (shown best at FIGS. 4 and 5). As further recounted in U.S. Pat. No. 5,715,135, the upper half member 102 is further provided with apertures 124 in the form of terminal slots for fixedly receiving terminals 126 having wire slots 128 (see FIG. 2*d*).

When the end portion 108 is received seatingly into the recess 106, the apertures 130 align with respective apertures 124' in the form of corresponding holes and/or terminal slots on the BEDC at the recess.

Figure 2C:
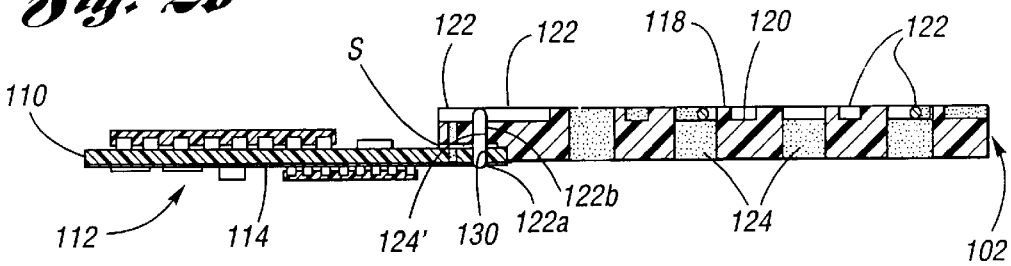

Next, the combined assemblage of the PCB 112 and upper half member 102 is placed in a buss wire routing machine where the bussed circuits for the BEDC are created. As shown at FIG. 2*c*, the buss wires 122 are laid in the wiring channels 120 in a predetermined pattern. The buss wires 122 are, where appropriate, planted through the apertures 130, 124' which are in the form of holes in the PCB and the BEDC, respectively.

Figure 2D:
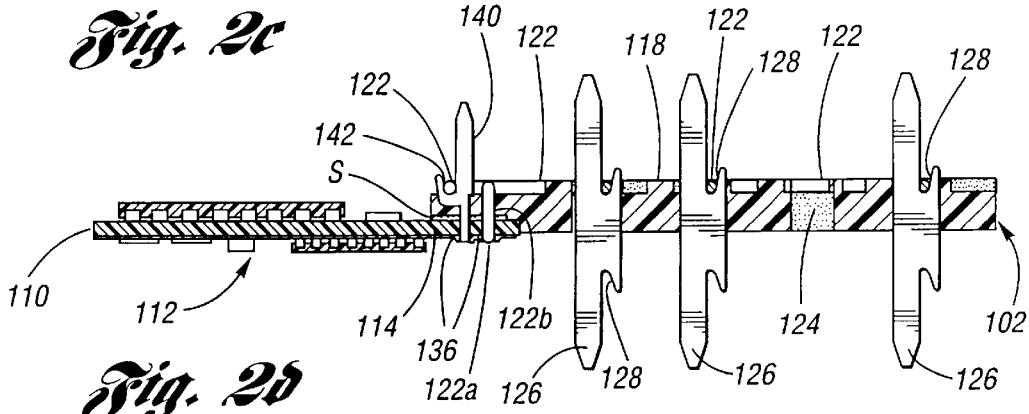

As shown at FIG. 2*d*, the terminals 126 are press fit into the terminal slots 124 of the upper half member 102, and, where appropriate, the buss wires 122 are pressed into the wire slots 128 of the terminals 126. Similarly, where terminals 140 are placed into the apertures 130 of the PCB 112, where appropriate the buss wires 122 press fit into wire slots 142 thereof.

The end 122*a* of the planted portion 122*b* of the buss wires 122 are now soldered, via a solder joint 136 to the conductive path 114 of the PCB 112. Similarly, the planted end 132*a* of the terminals 132 is soldered, via another solder joint 136, to the electrically conductive path 114. In this regard, it is preferred to use a fountain wave soldering methodology that is well known in the soldering arts.

Figure 2E:
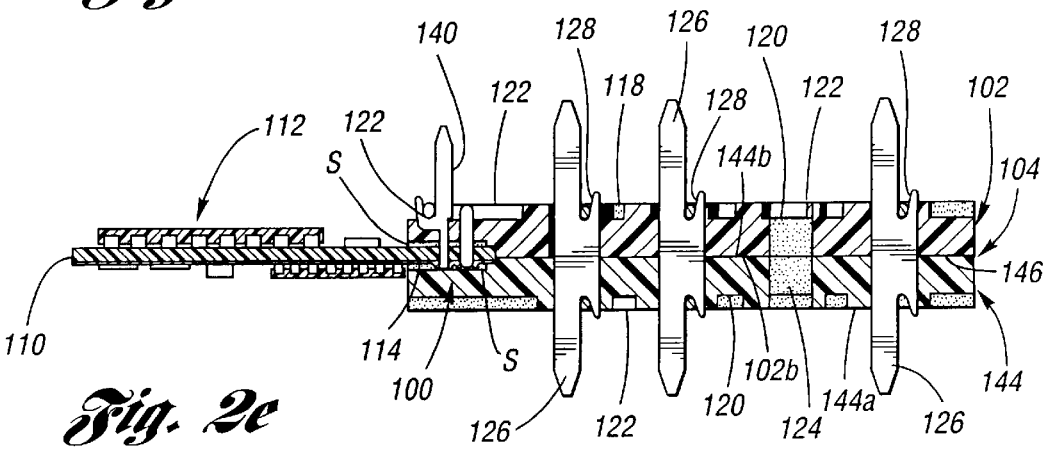

As shown at FIG. 2*e*, the lower half member 144 of the main insulation assembly 104 is configured similar to the upper half member 102, including the recess for receiving the PCB in the manner hereinabove described. Terminals 126 are similarly press fit 126 and buss wires 122 are similarly laid down in the wiring channels of the outer face 138*a* thereof and press fit into the wire slots 128 of the terminals. When the inner faces 102*b*, 144*b* of the upper and lower half members 102, 138 are brought into abutment to thereby assemble the main insulation assembly 104 of the BEDC, the substrate 110 is in alignment with the interface 146 therebetween and the recess serves to firmly sandwich the edge and afford spacings S adjacent thereto. Finally, the entire assembly is then cold staked to lock the terminals and PCB 112 in position relative to the upper and lower half members 102, 144. In this regard the upper and lower half members afford strain relief to the solder joints 136.

It will be noted that the interconnect system 100 provides simultaneously a mechanical and electrical direct interface between the PCB and the BEDC, wherein external wiring need only be connected through the BEDC.

Figure 3:
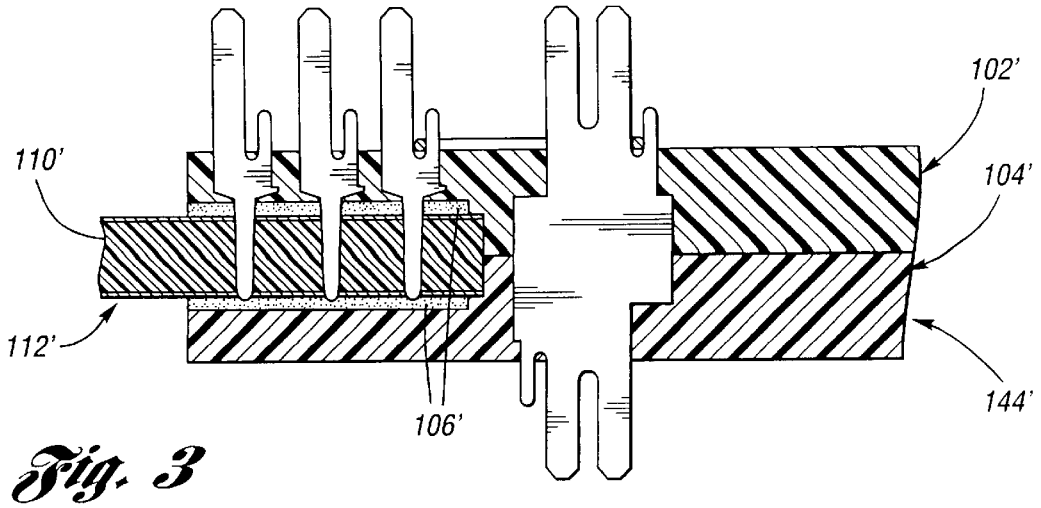
FIG. 3 is a detail, partly sectional view of an alternative configuration for mounting a PCB with respect to a BEDC according to the present invention.

FIG. 3 depicts a variation of the interconnect system, wherein a populated PCB 112' is integrated with a main insulation assembly 104', wherein each of the upper half member 102' and the lower half member 144' are provided with a portion of the recess 106', and wherein the substrate 110' is situated fixedly therein.

Figure 4:
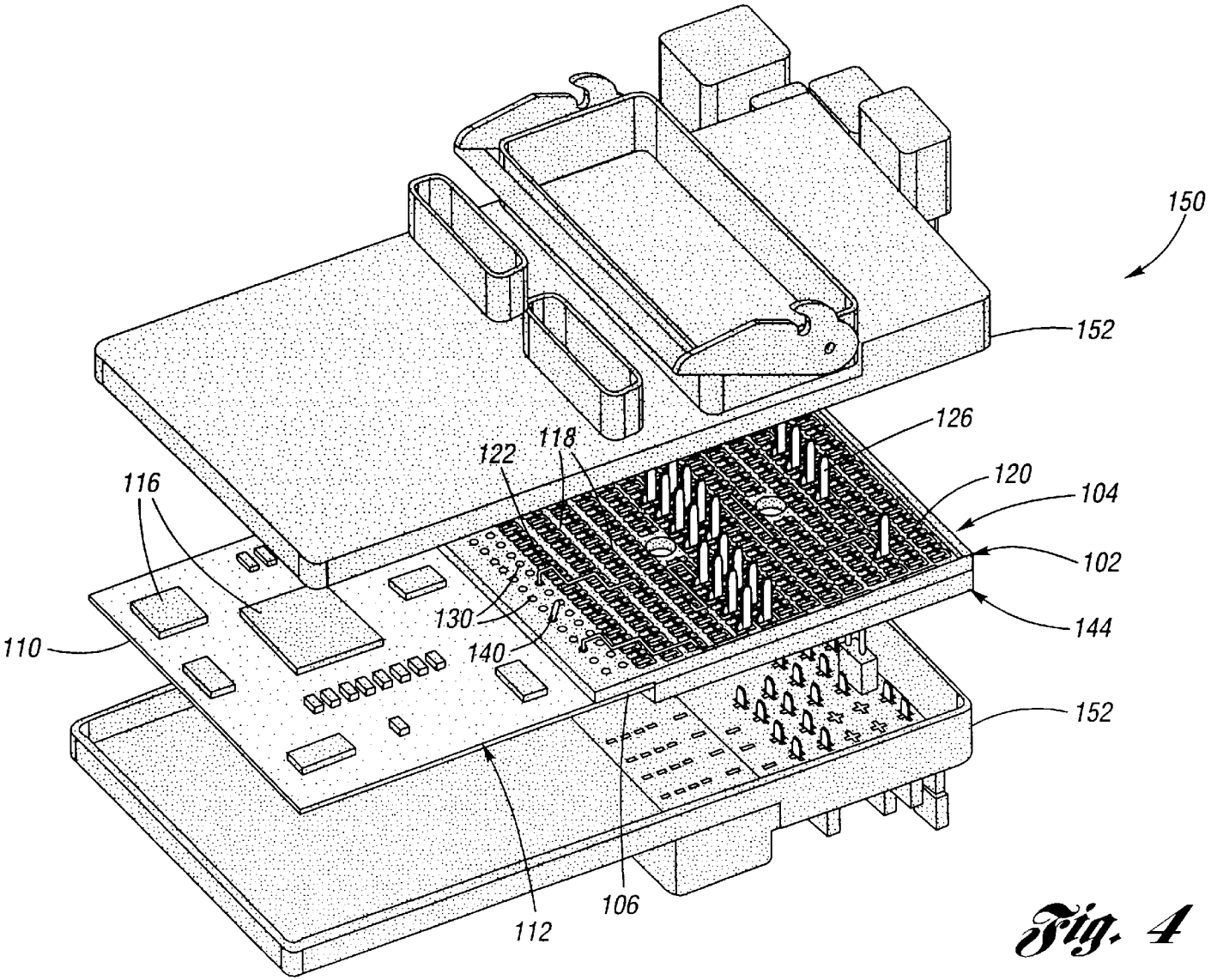
FIG. 4 is an exploded perspective view of a first example of an integrated BEDC and PCB according to the present invention.

FIG. 4 depicts an example for carrying out the interconnect system, wherein a BEDC 150 is integrated with the PCB 112, upper half member 102 and lower half member 144 of FIG. 2*e*. The PCB 112 is interfaced at the recess 106 of the upper half member 102, and the upper half member is interfaced with the lower half member 144 to form the main insulation assembly 104. The terminals 126, guides 118, wiring channels 120 and buss wires 122 are as described hereinabove with respect to FIGS. 2*a* through 2*e*. An enclosure 152 provides external electrical connections and environmental protection.

Figure 5:
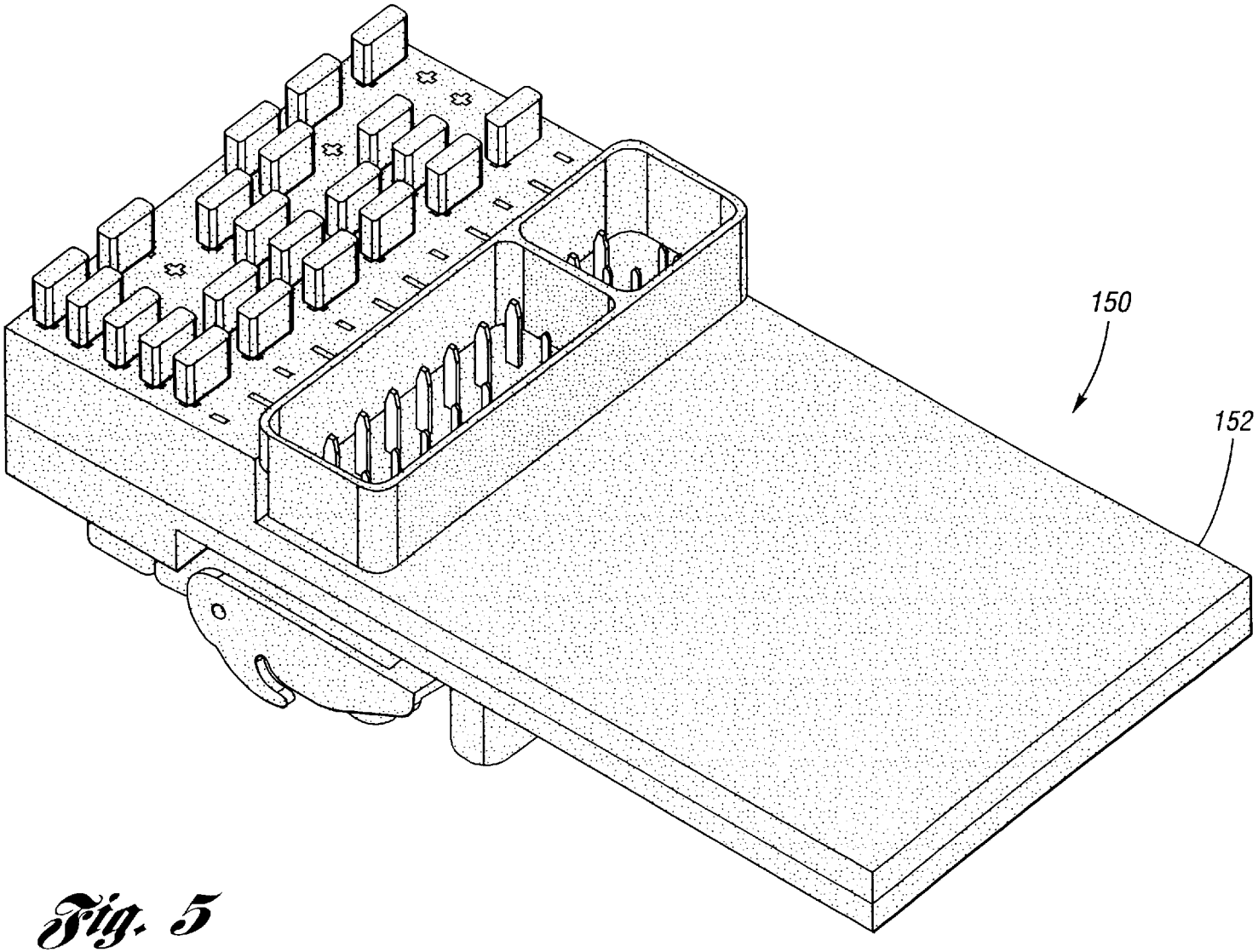
FIG. 5 is a perspective view of the integrated BEDC and PCB of FIG. 4 in a fully assembled state.

FIG. 5 depicts the integrated BEDC unit 150 in a fully assembled state.

Figure 6:
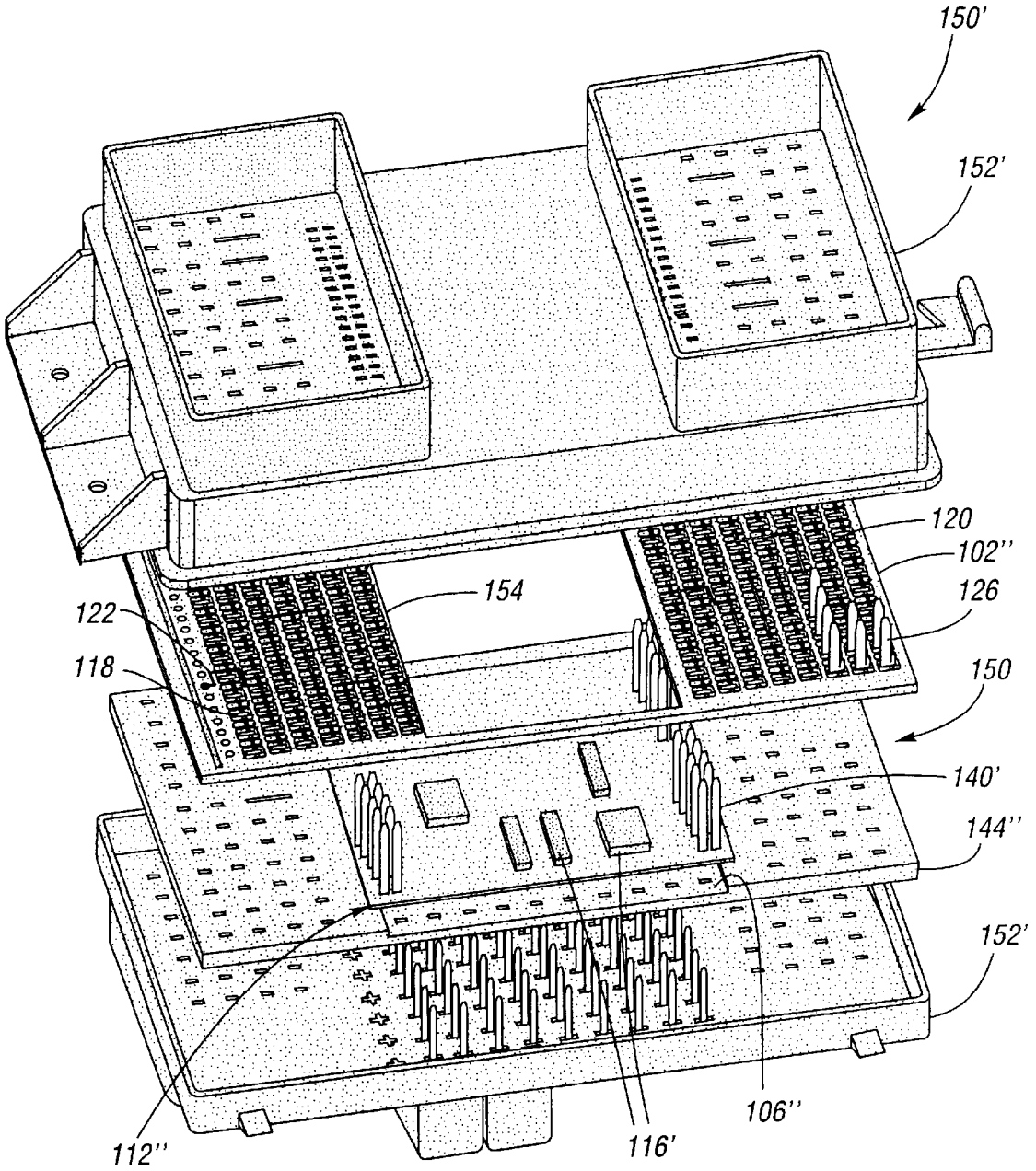
FIG. 6 is an exploded perspective view of a second example of an integrated BEDC and PCB according to the present invention.

FIG. 6 depicts a second example for carrying out the interconnect system 100, wherein a BEDC 150' includes a PCB 112" entirely received by a recess 106" of the lower half member 144" and the electronic components 116' project into an opening 154 formed in the upper half member 102". The terminals 140' are, at least in part, in the form of micro pack terminal pins. The terminals 126, guides 118, wiring channels 120 and buss wires 122 are as described hereinabove with respect to FIGS. 2*a* through 2*e*. An enclosure 152' provides external electrical connections and environmental protection.

Some of the distinguishing advantages of the interconnect system 100 are:

a) A conventional wiring harness connecting the PCB to the BEDC is eliminated, as are the associated connectors.

b) Custom routed buss wiring from the BEDC is solderingly connected to the PCB, thereby greatly enhancing reliability.

c) The number of parts and the amount of material is minimized because of a co-location design and a common enclosure.

d) Common mounting features and fewer connectors simplifies installation and minimizes connect labor.

e) Connection to external electronics is simplified, in that an integrated connector can accommodate BEDC electronics and PCB I/O.

f) The PCB may be used to achieve bussing of some low current circuits.

g) Solid state devices on the PCB may be used to replace pluggable mechanical relays of the BEDC.

To those skilled in the art to which this invention appertains, the above described preferred embodiments may be subject to change or modification. Such change or modification can be carried out without departing from the scope of the invention, which is intended to be limited only by the scope of the appended claims.

We claim:

1. An interconnect system for directly connecting a printed circuit board to a bussed electrical distribution center, comprising:

a bussed electrical distribution center comprising a main insulation assembly having a plurality of apertures and a plurality of wiring channels selectively intersecting said plurality of apertures, said bussed electrical distribution center further comprising at least one buss wire resident in said plurality of wiring channels, said main insulation assembly having a recess intersecting a selected number of apertures of said plurality of apertures;

a printed circuit board having a substrate, said substrate having a conductive path cladded thereto, said substrate having a plurality of apertures intersecting said conductive path; and connection means for electrically connecting said at least one buss wire to said conductive path when at least a portion of said printed circuit board is received in said recess.

2. The interconnection system of claim 1, wherein said connection means comprises said at least one buss wire passing into said at least one apertures of said printed circuit board, wherein said at least one buss wire is soldered to said conductive path.

3. The interconnection system of claim 1, wherein said connection means comprises at least one terminal passing through said at least one aperture of said printed circuit board and passing through said at least one aperture of said main insulation assembly;

wherein said at least one terminal is press-fit connected to said at least one buss wire and solderingly connected to said conductive path.

4. The interconnection system of claim 1, wherein said main insulation assembly comprises an upper half member interconnectable with a lower half member, wherein said recess is formed in at least one of said upper and lower half members at an interface therebetween so that when said printed circuit board is received in said recess, said printed circuit board is at least in part sandwiched between said upper and lower half members.

5. The interconnection system of claim 4, wherein said at least one buss wire comprises at least one upper buss wire at said upper half member and at least one lower buss wire at said lower half member; wherein said connection means electrically connects said conductive path to at least one of said at least one upper buss wire and said at least one lower buss wire.

6. The interconnection system of claim 5, wherein said connection means comprises at least one of said at least one upper and lower buss wires passing into said at least one apertures of said printed circuit board and soldered to said conductive path.

7. The interconnection system of claim 5, wherein said connection means comprises at least one terminal passing through said at least one aperture of said printed circuit board and passing through said at least one aperture of said main insulation assembly;

wherein said at least one terminal is press-fit connected to at least one of said at least one upper and lower buss wires and solderingly connected to said conductive path.

8. The interconnection system of claim 5, wherein said connection means electrically connects said conductive path to said at least one upper buss wire and to said at least one lower buss wire.

9. The interconnection system of claim 8, wherein said connection means comprises at least one of said at least one upper buss wires and at least one of said lower buss wires passing into said at least one apertures of said printed circuit board and soldered to said conductive path.

10. The interconnection system of claim 5, wherein said connection means comprises at least one terminal passing through said at least one aperture of said printed circuit board and passing through said at least one aperture of said main insulation assembly;

wherein said at least one terminal is press-fit connected to at least one of said at least one upper buss wires and said at least one lower buss wires and solderingly connected to said conductive path.

* * * * *